United States Patent [19]

Fernandez et al.

[11] 4,033,261

[45] July 5, 1977

[54] DEVICE FOR DRIVING THE PLATE CYLINDER IN ROTARY PRINTING PRESSES, PARTICULARLY OFFSET PRINTING PRESSES

[75] Inventors: Eloy Fernandez, Heusenstamm; Claus Simeth, Offenbach; Georg Herzan, Eschborn, all of Germany

[73] Assignee: Roland Offsetmaschinenfabrik Faber & Schleicher AG, Germany

[22] Filed: Nov. 1, 1976

[21] Appl. No.: 737,208

[30] Foreign Application Priority Data

Nov. 12, 1975 Germany ..... 2550719

[52] U.S. Cl. ..... 101/248; 74/400

[51] Int. Cl.[2] ..... B41F 13/14

[58] Field of Search ..... 101/248, 212, 216; 74/395, 400, 401, 402, 403, 396, 397, 405, 406

[56] References Cited

UNITED STATES PATENTS

| | | | |
|---|---|---|---|
| 2,775,935 | 1/1957 | Reinartz et al. | 101/248 |
| 3,368,419 | 2/1968 | Puxkandl | 74/401 |

*Primary Examiner*—J. Reed Fisher

*Attorney, Agent, or Firm*—Leydig, Voit, Osann, Mayer & Holt, Ltd.

[57] ABSTRACT

A drive connection between a sleeve on the printing cylinder of a printing press and a hub on the associated driving gear, the hub being freely telescoped over the surface of the sleeve and the sleeve and hub having radially opposed grooves occupied by a key in the form of an entrainer. The entrainer includes two complimentary wedge portions which are mated along a substantially radially extending plane which is arranged at a shallow angle to the cylinder axis. The entrainer presents parallel lateral surfaces which register with the groove in the hub while only one of the wedge portions registers with the groove in the sleeve. Axial adjusting means are provided for captively interconnecting the wedge portions for adjusting the relative axial positions in opposite directions thereby to vary the spacing between the lateral surfaces to achieve a precise sliding fit with respect to the side walls of the groove in the hub thereby to take up any rotational play between the sleeve and the hub while permitting relative axial shifting of the cylinder for the purpose of adjusting the axial register of the printing plate. In a preferred form of the invention roller bearings are interposed between the entrainer and the walls of the groove, with the surfaces which are engaged by the roller bearings being hardened to prevent indentation.

5 Claims, 3 Drawing Figures

DEVICE FOR DRIVING THE PLATE CYLINDER IN ROTARY PRINTING PRESSES, PARTICULARLY OFFSET PRINTING PRESSES

It is convenient in registering a thin lithographic printing plate to provide for peripheral register between the plate and the cylinder but to achieve axial register by axially moving the cylinder on which the plate is mounted. Where the driving gear for the cylinder is axially captive in the press frame to serve as a reference element, provision has been made for endwise movement of the cylinder with respect to the hub of the driving gear. To provide a drive connection while accommodating relative axial movement a special type of key, known as a feather key, has been provided between the driving gear and the shaft of the cylinder. Achieving the axial fit required to achieve free sliding movement but with total elimination of rotational play has required hand fitting which is both difficult and expensive. Indeed, where the width of the groove in the cylinder shaft and the width of the groove in the gear hub lie near the upper and lower limits of the machining tolerances it is manifestly impossible to achieve a feather key dimension which is close fitted to each of the grooves without providing offset surfaces. Where the feather key is permitted to have a tight or drive fit with respect to one of the grooves and a sliding fit with respect to the other, there is risk of deforming the part having the tight fit with danger of introducing eccentricity.

Accordingly, it is an object of the invention to provide a drive connection between a plate cylinder and its driving gear which permits free relative sliding between the two, in the axial direction, but which completely eliminates any possibility of rotational play.

It is a related object of the invention to provide an entrainer which fits into radially opposed axial grooves in the gear and cylinder structure which is made up of two complimentary wedge portions which permit precise variation in spacing between lateral surfaces on the entrainer to achieve the desired endwise adjustment of the cylinder while eliminating any possiblity of axial play regardless of the width of the grooves into which the entrainer is fitted. It is a related object, in this connection, to provide a drive connection for a printing cylinder which does not require high precision in the machining of the grooves but which may be easily and quickly accommodated to the groove dimensions to achieve the contradictory requirements of sliding fit and lack of play.

It is yet another object of the invention to provide a drive connection between a plate cylinder and driving gear which is distinguished by a high degree of economy plus long life with a minimum of wear, but in which any slight amount of wear which might take place may be easily and quickly compensated for by take-up adjustment performed from time to time for the life of the press.

It is a more specific object of the invention to provide an entrainer construction for a printing press cylinder in which anti-friction bearings are incorporated to achieve free relative motion but in which it is possible to eliminate any possibility of play by establishing a condition of pre-load between the engaged surfaces.

Other objects and advantages of the invention will become apparent upon reading the attached detailed description and upon reference to the drawings in which.

Figure 1:
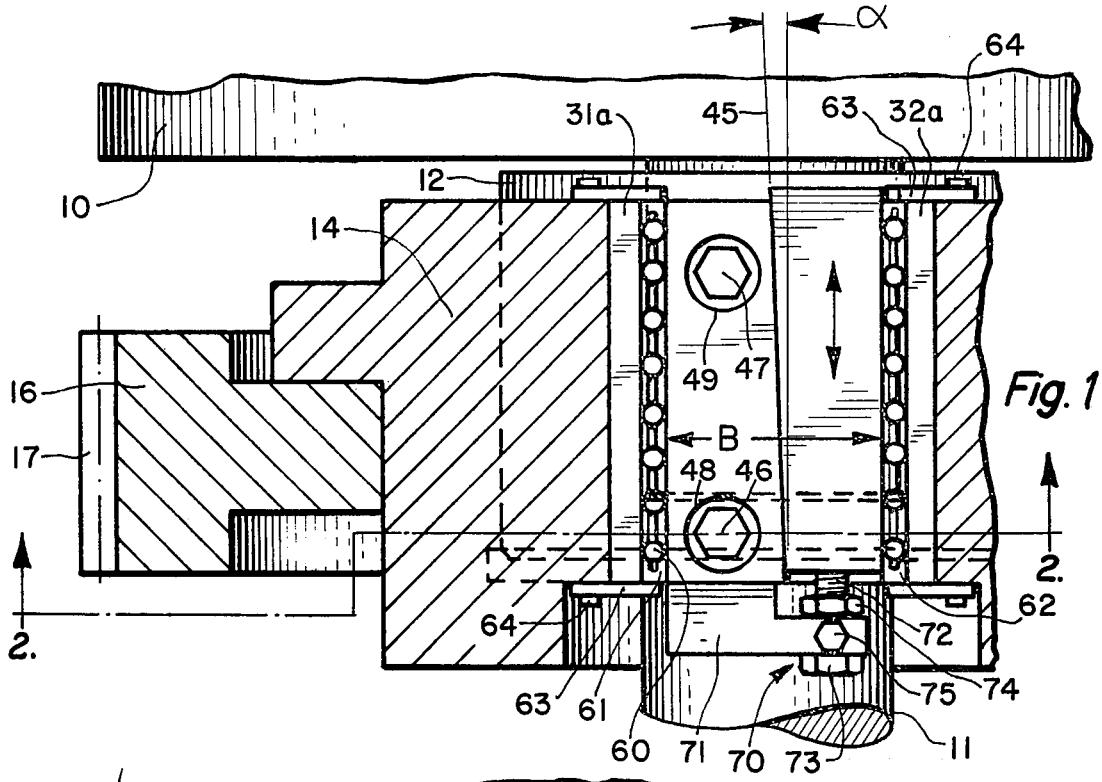
FIG. 1 is a sectional view taken axially through the drive connection along line 1—1 in FIG. 2.
Figure 2:
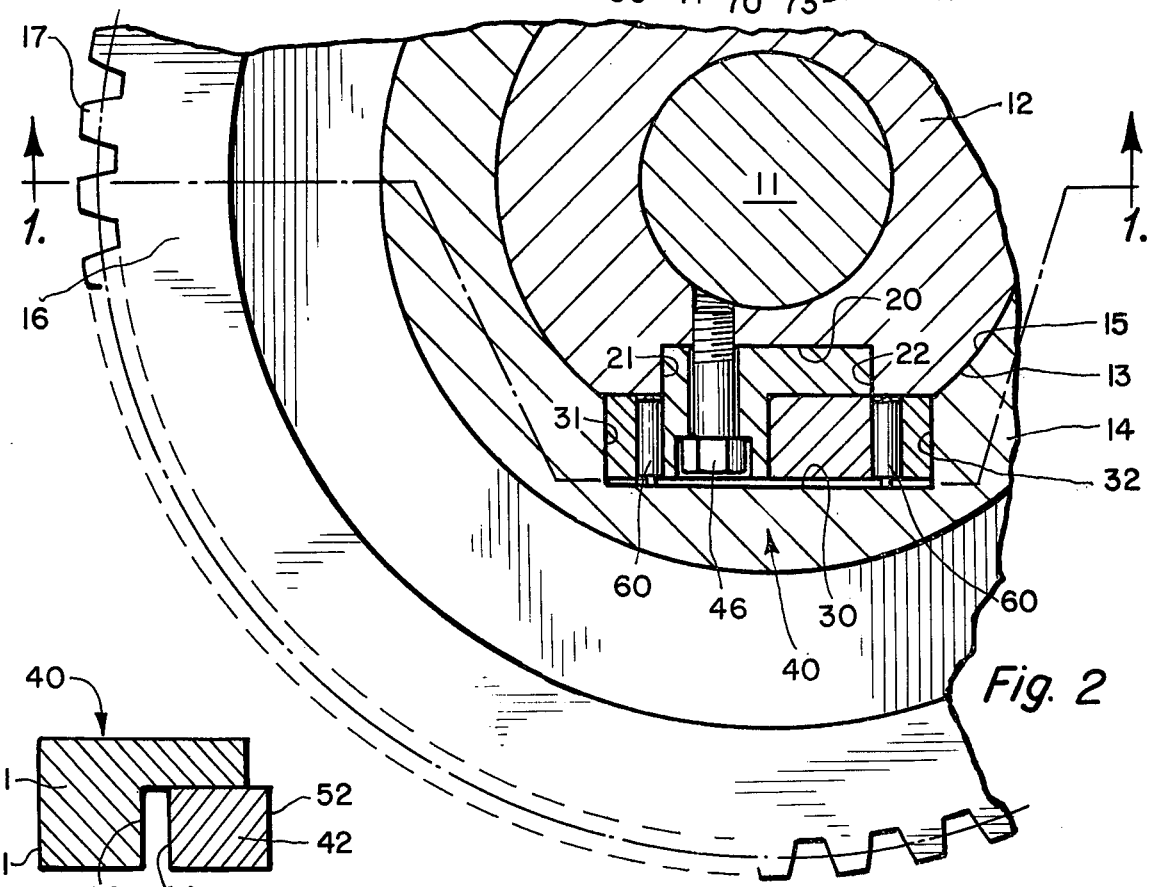
FIG. 2 is a fragmentary end view in partial section looking along the line 2—2 in FIG. 1.
Figure 2A:
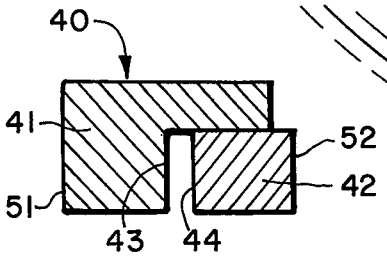
FIG. 2*a* shows the parts exploded.

While the invention has been described in connection with a preferred embodiment, it will be understood that we do not intend to be limited to the particular embodiment shown but intend, on the contrary, to cover the various alternative and equivalent constructions included within the spirit and scope of the appended claims.

Turning to the drawings there is shown a portion of a plate cylinder 10 having a shaft or journal 11 encircled by a sleeve 12 which will be understood to be rigidly secured to the shaft or journal, presenting a cylindrical outer surface 13. Telescoped over the sleeve is a hub 14 having a cylindrical inner surface 15, with the relatively telescoping surfaces 13, 15 having a free sliding fit. The hub 14 serves as a rigid mounting for a drive gear 16 having teeth 17 about its periphery.

For drivingly coupling the hub 14 to the sleeve 12 the sleeve and hub are both provided with opposed axial grooves occupied by a driving key which is referred to as an entrainer. Thus the sleeve 12 has a groove 20 having side walls 21, 22 while the hub 14, which surrounds it, is formed with an axially extending groove 30 having side walls 31, 32. The entrainer 40 which occupies the grooves, and which takes the place of the feather key provided in conventional constructions, has a base portion 41 which is clamped in the groove 20 formed in the sleeve and a relatively sliding portion 22. The base portion 41 is preferably of L cross section with one leg of the L being nested in the groove 20 while the relatively slidable portion 42 is of simple bar shape nested in the notch of the L. The two portions 41, 42 have mating wedge surfaces 43, 44 which meet along a substantially radially extending plane 45 which is arranged at a shallow angle $\alpha$ with respect to the cylinder axis. For the purpose of maintaining the base portion 41 seated in the groove 20, the base portion is fitted with a pair of machine screws 46, 47 which are tapped into the body of the sleeve 12 and the heads of which are recessed in counter bores 48, 49.

The entrainer presents parallel lateral surfaces 51, 52 which are arranged opposite the parallel side walls 31, 32 of the groove which is formed in the hub.

In accordance with one of the aspects of the present invention the walls 31, 32 of the groove are provided with hardened face plates **31*a*, 32*a*, the surfaces 51, 52 of the entrainer, which are opposed thereto, are also hardened, and interposed between the hardened surfaces are respective sets of roller bearings. The roller bearings, indicated at 60, are mounted, in spaced positions, in respective planar cages 61, 62. The cages are restrained against endwise movement with respect to the hub 14 by retaining lugs 63 which may be held in place by small machine screws 64**.

In accordance with one of the important features of the invention an axial adjusting means is provided for captively interconnecting the two wedged portions 41, 42 of the entrainer for adjusting their relative axial position in opposite directions thereby varying the spacing between the parallel lateral surfaces 51, 52 to achieve a precise freely slidable fit with respect to the groove in the hub, thereby to take up any rotational play between the sleeve and the hub while permitting relative axial shifting of the cylinder for the purpose of adjusting the axial register of the printing plate. The means 70 for achieving the relative axial adjustment is preferably in the form of a bracket 71 which is rigidly secured to the end of the portion 41 of the entrainer and which is in captive engagement with a screw 72 which is tapped into the relatively sliding portion 42 of the entrainer. Trapping the screw is achieved by forming the screw with spaced shoulders 73, 74 which may, in a practical case, be formed by the head of the screw and a nut which is permanently fixed to the screw in spaced relation. A set screw 75 in the bracket 71 prevents unwanted rotation of the screw after relative adjustment between the parts 41, 42 has been achieved. It will be apparent that upon rotating the screw 72 in one direction or the other the spacing B between the lateral surfaces 51, 52 of the entrainer may be adjusted with a high degree of precision. Specifically, by taking up on the screw 72 the surfaces 43, 44 (FIG. 3) are increasingly engaged, wedging the lateral surfaces 51, 52 outwardly to bring about a gradual increase in the width dimension thereby taking up any play between the entrainer and the side walls 31, 32 of the groove which is formed in the hub.

Thus it will be apparent that in machining the groove 30 in the hub the dimension between the side walls 31, 32 thereof need not be maintained with any high order of accuracy. Nor do the face plates 31*a*, 32*a* need be machined with any high order of accuracy in the thickness dimension except that the opposite faces thereof should be parallel to one another. Indeed the thickness of the two portions of the entrainer along the direction B need not be of high order of accuracy as long as parallelism is maintained between the lateral surfaces 51, 52 when the two portions are seated together. Whatever error may exist in the system in the width dimension may be easily compensated by turning the adjusting screw 72 in one direction or the other.

While the use of roller bearings 60 is preferred, use of such bearings is not essential to the present invention. Roller bearings do, however, have the substantial advantage that the adjusting screw 72 may be tightened slightly beyond the point where play in the driving direction is taken up; the adjusting screw, indeed, may be tightened to the point of slight pre-load against the roller bearings which insures against future development of play without, however, defeating the desired relative movement between the cylinder and sleeve 12 on the one hand and the hub 14 of the gear on the other.

Because of the use of the hardened wear surfaces any indenting or development of play due to subsequent wear and torque loading is either defeated or reduced to an absolute minimum. If any play should, for any reason, tend to develop over the years of use of the construction, it may be easily and quickly compensated for simply by slight take-up at the adjusting screw 72. Because of avoidance of play between the cylinder and the gear which drives it, a high degree of precision in peripheral register and a high degree of printing quality may be maintained over the life of the press.

The means for relatively adjusting the wedge portions preferably consists of a bracket 71 on one of them and a screw 72 on the other, with the wedge portions thus being directly interconnected in captive relation. However, such captive connection can if desired be indirect as, for example, where the bracket or screw is secured to the sleeve instead of to the base wedge portion 41. Also, without departing from the invention, the sleeve 12 may be integral with the cylinder shaft.

The term "sliding" as used herein refers to endwise motion regardless of the presence of anti-friction bearings to facilitate that motion. A typical construction for holding the drive gear axially captive while the cylinder and plate are adjusted for axial register is shown in Reinartz et al. U.S. Pat. No. 2,775,935.

What we claim is:

1. A drive connection between a plate cylinder of a printing press and the driving gear therefor, the driving gear being axially located with respect to the press frame, comprising, in combination, a sleeve secured to the shaft of the plate cylinder and having a cylindrical outer surface, a hub on the gear having a cylindrical inner surface which is freely telescoped over the outer surface of the sleeve, the sleeve and hub having respective radially opposed axial grooves keyed together by an entrainer, the entrainer presenting parallel lateral surfaces for registering with the groove in the hub, the entrainer being formed of a base wedge portion and a slide wedge portion mated in complimentary fashion along a substantially radially extending plane which is arranged at a shallow angle with respect to the cylinder axis, the base wedge portion having means for securing it in seated position in the groove formed in the sleeve, and axial adjusting means captively interconnecting the wedge portions for adjusting the relative axial positions of the wedge portions in opposite directions thereby to vary the spacing between the parallel lateral surfaces to achieve a precise sliding fit with the groove in the hub thereby to take up any rotational play between the sleeve and the hub while enabling relative axial shifting of the cylinder for the purpose of adjusting axial register of the printing plate.

2. The combination as claimed in claim 1 in which roller bearings are interposed between the lateral surfaces of the entrainer and the opposed walls of the groove in the hub and in which the surfaces engaged by the rollers are hardened.

3. The combination as claimed in claim 1 in which anti-friction bearings are interposed between the lateral surfaces of the entrainer and the respective adjacent side walls of the groove in the hub, the bearings having planar cages for spacing the same, the hub being provided with retainers for holding the cages axially captive therein.

4. A drive connection between a plate cylinder of a printing press and a driving gear therefor, the driving gear being axially located with respect to the frame of the press, comprising, in combination, a sleeve secured to the shaft of the plate cylinder and having a cylindrical outer surface, a hub on the gear having a cylindrical inner surface which is freely telescoped over the outer surface of the sleeve, the sleeve and the hub having radially opposed axial grooves, an entrainer formed of a base wedge portion and a slide wedge portion, the base wedge portion being of L cross section and the slide wedge portion being nested therein in complimentary fashion thereby to present parallel lateral surfaces for registering with the groove in the hub, the portions being mated along a substantially radially extending plane which is arranged at a shallow angle with respect to the cylinder axis, the base wedge portion having means for securing it in the groove in the sleeve, axial adjusting means captively interconnecting the wedge portions for adjusting the relative axial positions of the wedge portions in opposite directions thereby to vary the spacing between the parallel lateral surfaces to achieve a precise sliding fit with the groove in the hub thereby to take up any rotational play between the sleeve and the hub while enabling relative axial shifting of the cylinder with respect to the drive gear for the purpose of adjusting axial register of the printing plate.

5. A drive connection between a plate cylinder of a printing press and the driving gear therefor, the driving gear being axially located with respect to the press frame, comprising, in combination, a sleeve secured to the shaft of the plate cylinder and having a cylindrical outer surface, a hub on the gear having a cylindrical inner surface which is freely telescoped over the outer surface of the sleeve, the hub having an axial groove having parallel sides and the sleeve having a recessed mounting surface opposite the groove, an entrainer in the groove for keying the sleeve and hub drivingly together, the entrainer presenting parallel lateral surfaces for registering with the sides of the groove in the hub, the entrainer being formed of a base wedge portion and a slide wedge portion mated in complimentary fashion along a substantially radially extending plane which is arranged at a shallow angle with respect to the cylinder axis, the base wedge portion having means for securing it in seated position on the mounting surface on the sleeve, and threaded adjusting means captively interconnecting the wedge portions for adjusting the relative axial positions of the wedge portions in opposite directions thereby to vary the spacing between the parallel lateral surfaces of the entrainer to achieve a precise sliding fit with the groove in the hub thereby to take up any rotational play between the sleeve and the hub while enabling relative axial shifting of the cylinder for the purpose of adjusting axial register of the printing plate.

* * * * *